US007697019B2

(12) United States Patent
Marsh et al.

(10) Patent No.: US 7,697,019 B2
(45) Date of Patent: Apr. 13, 2010

(54) SYNCHRONOUS DUPLEX PRINTING SYSTEMS USING DIRECTED CHARGED PARTICLE OR AEROSOL TONER DEVELOPMENT

(75) Inventors: Dana G. Marsh, Newark, NY (US); George R. Walgrove, III, Rochester, NY (US); Michael W. Frauens, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 54 days.

(21) Appl. No.: 11/934,100

(22) Filed: Nov. 2, 2007

(65) Prior Publication Data

US 2008/0122916 A1 May 29, 2008

Related U.S. Application Data

(63) Continuation of application No. 11/089,383, filed on Mar. 24, 2005, now Pat. No. 7,391,425.

(51) Int. Cl.
*B41J 2/41* (2006.01)

(52) U.S. Cl. ..... 347/120; 399/309

(58) Field of Classification Search ..... 347/120; 399/299, 309

See application file for complete search history.

(56) References Cited

U.S. PATENT DOCUMENTS 4,191,465 A 3/1980 Boase et al.
4,212,529 A 7/1980 O'Brien et al.
4,214,831 A 7/1980 Reesen
4,447,176 A 5/1984 Blough et al.
4,473,029 A 9/1984 Fritz et al.
4,546,060 A 10/1985 Miskinis et al.
5,070,369 A 12/1991 Mahoney et al.
5,070,371 A 12/1991 Randall
5,070,372 A 12/1991 Randall
5,461,470 A * 10/1995 De Cock et al. ..... 399/228
5,797,077 A * 8/1998 Samizo et al. ..... 399/309
5,799,226 A 8/1998 Shigeta et al.
5,799,236 A 8/1998 Paczkowski
5,826,143 A 10/1998 Haneda et al.
5,899,611 A 5/1999 Haneda et al.
5,905,931 A 5/1999 Shigeta et al.
5,930,572 A 7/1999 Haneda et al.
5,970,277 A 10/1999 Shigeta et al.
5,991,563 A 11/1999 Haneda et al.
6,038,410 A 3/2000 Iriyama
7,295,799 B2 * 11/2007 Marsh et al. ..... 399/309
7,391,425 B2 * 6/2008 Marsh et al. ..... 347/120

OTHER PUBLICATIONS

U.S. Appl. No. 60/551,464, "Powder Coating Apparatus and Method of Powder Coating Using an Electromagnetic Brush," filed Mar. 9, 2004, Stelter, et al.

* cited by examiner

*Primary Examiner*—Huan H Tran
(74) *Attorney, Agent, or Firm*—Donna P. Suchy

(57) ABSTRACT

An imaging system may include first and second imaging assemblies for synchronously imaging on both sides of a receiver material using directed charged particle or aerosol toner printing methods. The imaging assemblies may in turn each include an imaging member and an intermediate transfer member, and the intermediate transfer member may be a split intermediate transfer member. The imaging system may also use flexible aperture print arrays.

7 Claims, 13 Drawing Sheets

SYNCHRONOUS DUPLEX PRINTING SYSTEMS USING DIRECTED CHARGED PARTICLE OR AEROSOL TONER DEVELOPMENT

CROSS REFERENCE TO RELATED APPLICATIONS

This application is a Continuation of Utility patent application Ser. No. 11/089,383, filed on Mar. 24, 2005, now U.S. Pat. No. 7,391,425 entitled "SYNCHRONOUS DUPLEX PRINTING SYSTEMS USING DIRECTED CHARGED PARTICLE OR AEROSOL TONER DEVELOPMENT, incorporated by reference herein and commonly-assigned to the Eastman Kodak Company.

FIELD OF THE INVENTION

The invention generally relates to electrographic and electrophotographic printers using directed charged particle or aerosol toner development. More specifically, it relates to the synchronous transfer of images onto both sides of a receiver using directed charged particle or aerosol toner development.

BACKGROUND OF THE INVENTION

Electrographic and electrophotographic processes form images on selected receivers, typically paper, using small dry colored particles called toner. The toner usually comprises a thermoplastic resin binder, dye or pigment colorants, charge control additives, cleaning aids, fuser release additives, and optionally flow control and tribocharging control surface treatment additives. The thermoplastic toner is typically attached to a print receiver by a combination of heating and pressure using a fusing subassembly that partially melts the toner into the fibers at the surface of the receiver.

Typically, in an electrographic or electrophotographic printer or copier (collectively referred to herein as "printers"), a heated fuser roller/pressure roller nip is used to attach and control the toner image to a receiver. Heat can be applied to the fusing rollers by a resistance heater, such as a halogen lamp. And, it can be applied to the inside of at least one hollow roller and/or to the surface of at least one roller. At least one of the rollers in the heated roller fusing assembly is usually compliant, and when the rollers of the heated roller fusing assembly are pressed together under pressure, the compliant roller then deflects to form a fusing nip.

Most heat transfer between the surface of the fusing roller and the toner occurs in the fusing nip. In order to minimize "offset," which generally refers to the amount of toner that adheres to the surface of the fuser roller, release oil is typically applied to the surface of the fuser roller. Release oil is generally made of silicone oil plus additives that improve the attachment of the release oil to the surface of the fuser roller and that also dissipate static charge buildup on the fuser rollers or fused prints. During imaging, some of the release oil attaches to the imaged and background areas of the fused prints.

The toner image resident on the surface of the imaging member, such as a photosensitive member or dielectric insulating member, may be transferred to a receiver material using a variety of different methods. For example, the transfer may be a direct transfer to the receiver material. Alternatively, the transfer may be an intermediate transfer in which toner is first transferred to an intermediate transfer medium and then transferred a second time in a second transfer station to the final receiver material. Other methods might also be used.

Various printers might have different printing capabilities depending on their design and their particular operational configurations. For example, different printers might have different imaging speeds. Some printers might be designed for low-capacity use and therefore might only be capable of imaging a relatively small number of pages within a given amount of time. Other printers, however, might be designed for high-capacity use and therefore might be capable of imaging a relatively large number of pages within the same amount of time.

In another example of differing print capabilities, some printers might only be capable of printing on a single side of a receiver material. Printing on a single side of a receiver medium is oftentimes referred to as simplex printing. Other printers might be capable of printing on both sides of a receiver material, which is oftentimes referred to as duplex printing. Duplex printing may be used in a variety of different applications, such as commercial printing applications and other high-volume applications. However, it might also be used in low-volume applications and non-commercial applications.

Conventional duplex imaging systems, however, may have various disadvantages. For example, many conventional duplex imaging systems require that the receiver passes through the system multiple times. U.S. Pat. No. 4,095,979 teaches transferring a first image to a first side of a copy sheet, inverting the copy sheet while the first image thereon remains unfixed, transferring the second unfixed image to the second side of the copy sheet, and then transporting the copy sheet with the first and second unfixed images to a fixing station.

U.S. Pat. Nos. 4,191,465, 4,212,529, 4,214,831, 4,447,176, 5,070,369, 5,070,371, 5,070,372, and 5,799,236 all teach the use of inverters, turn around drums, turn over stations and the like that require a receiver to make multiple passes through the system in order to image on both sides of the receiver. These systems, and others like them, require special handling of the receiver, which can reduce the speed with which the systems can perform duplex imaging.

U.S. Pat. Nos. 5,799,226, 5,826,143, 5,899,611, 5,905,931, 5,970,277, 5,930,572, 5,991,563, and 6,038,410 generally pertain to an apparatus in which a single photoconductor carrying a toner image comes into contact with a single intermediate transfer belt and transfers the image to the intermediate transfer belt at a first transfer station using a corona device. The intermediate transfer belt temporarily holds the first image and transports it in a similar fashion to permit the transfer of a second image from the photoconductor to the top-side of a receiver sheet at a first transfer station.

The belt then carries the receiver sheet with the top side image to a second transfer station at which the first image on the intermediate transfer belt is transferred to the bottom side of the receiver sheet. The receiver sheet with duplex images is then transported to a fixing station. Because the intermediate transfer belt temporarily holds the first image for a period of time representing one cycle of the intermediate transfer belt, the speed with which these systems can perform duplex imaging may also be limited. This can be disadvantageous for high-volume and high-speed imaging applications.

Directed aerosol toner development, in the general field of direct electrostatic printing, is an alternative to traditional electrophotographic systems. In directed aerosol toner development, a photoconductor is not required for image formation. Toner in the state of an airborne aerosol may be directed in an image-wise fashion to the surface of an insulating dielectric surface. Alternatively, a real image of toner particles may be written directly on a suitable recording medium.

The real toner image is then formed without the need for the charging and exposure steps used in conventional electrophotographic systems.

In addition, a simpler dielectric medium can be used to receive charged particles directly comprising a latent image of charges on the surface. Charged particles include, for example, ions (e.g., cations and anions), dry toner (e.g., electrophotographic and electrographically applied powder paint) and liquid toners (e.g., aqueous, non-aqueous, organic, inorganic, and inks). These are merely examples, and other charged particles might be used.

Light is generally not required in direct electrostatic printing systems, and therefore they also generally do not require the optical sub-systems that are used in conventional electrophotographic systems. In direct electrostatic printing, an aperture array print head system can be used to directly create either a latent image of charged ions that can be subsequently developed with toner material or to directly create a real image of toner particles. Such systems are described in various U.S. patents; however, these systems are not without disadvantages.

First, the printing aperture arrays are subject to attack and damage by reactive species created from the electrical breakdown of air, which is employed in various methods used to create the charged particles. In the electrical breakdown of air associated with, for example, corona emissions, numerous reactive species may be created. These species may include ozone, oxides of nitrogen, nitric acid, reactive atomic species, reactive molecular species and reactive ionic species. These reactive species can attack and damage the print array apparatus and therefore can cause degradation in image quality or even total stoppages in printing.

A second disadvantage of direct electrostatic printing aperture arrays used for the projection of charged particles, such as toner particles, is that the apertures can become clogged with toner material. This clogging reduces the size of the aperture thereby limiting the amount of toner available at the receiver. This can then lead to degradation in image quality of the final printed image. In addition, the toner clogging can reduce the reliability and life of the aperture print array. Other disadvantages may also exist.

Therefore, there exists a need for improved systems for duplex imaging and improved systems for directed aerosol toner printing.

SUMMARY OF THE INVENTION

An imaging system may synchronously image on both sides of a receiver material using directed charged particle or aerosol toner development. In exemplary embodiments, the imaging system may include imaging members and intermediate transfer members. The intermediate transfer members may optionally be 2-up split rollers, 3-up split rollers or another type of split roller.

The imaging system may also include one or more aperture print arrays used to directly create either a latent image of charged ions that can later be developed with toner material or to create a real image of toner particles. The surfaces of the aperture print arrays may optionally include one or more protective passivation layers, which can protect the aperture print arrays from the effects of various reactive species.

The aperture print arrays might be replaceable, such that a used aperture print array might be conveniently replaced with a new aperture print array. The aperture print arrays might also be made using flexible membrane technologies, and the aperture print arrays might be continuous ribbons that can be indexed either by a user of the imaging system or automatically by the imaging system. Various conditions, such as image quality, might be used to determine when to index the aperture print arrays.

These as well as other aspects and advantages of the present invention will become apparent from reading the following detailed description, with appropriate reference to the accompanying drawings.

BRIEF DESCRIPTION OF THE DRAWINGS

Exemplary embodiments of the present invention are described herein with reference to the drawings, in which.

DETAILED DESCRIPTION OF EXEMPLARY EMBODIMENTS

Figure 1A:
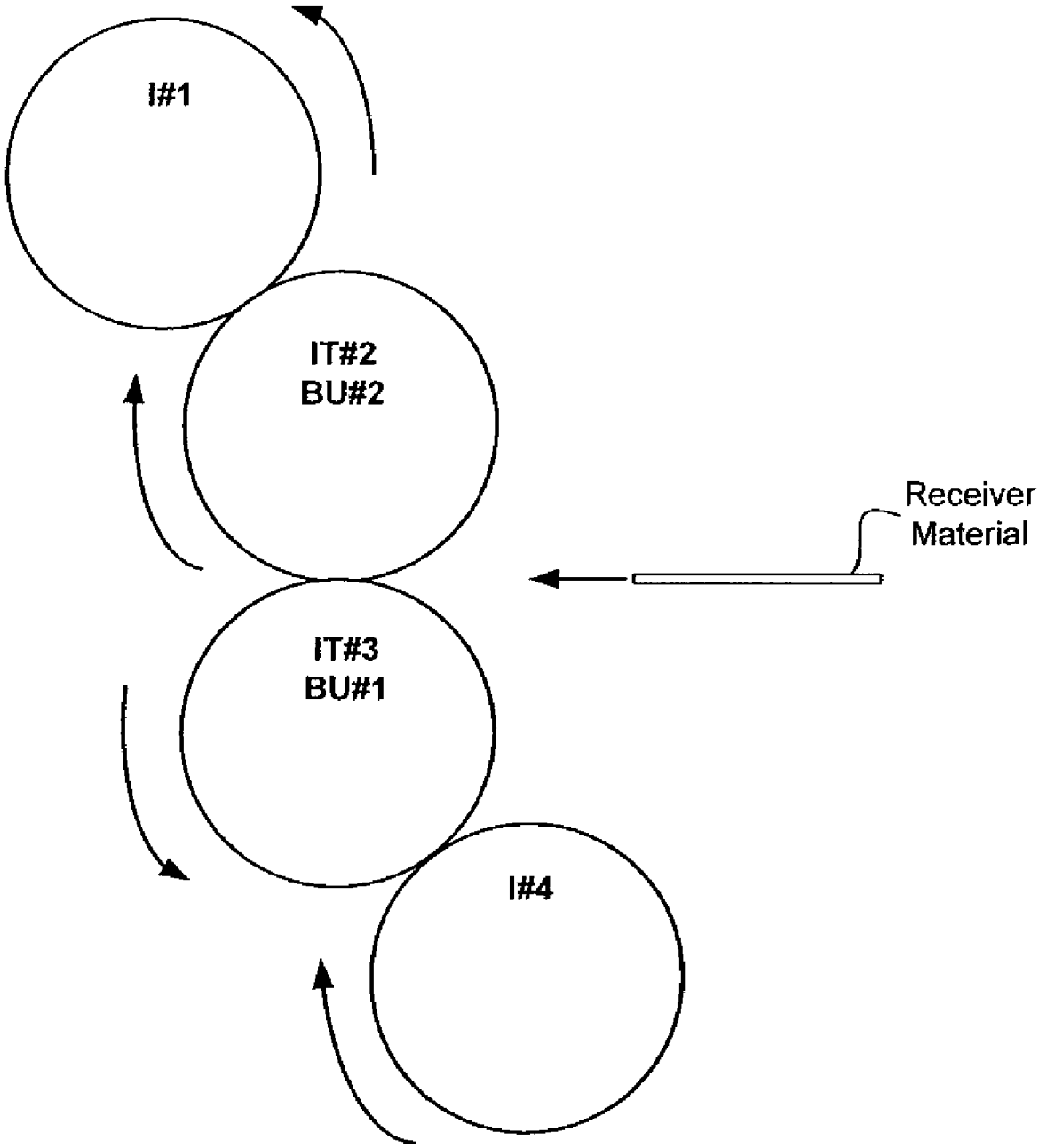
FIGS. 1A-D are block diagrams of an exemplary double-sided image formation system and various possible components in which images can be created on both sides of a receiver material in a single pass of the receiver material.

Electrographic or electrophotographic copiers or printers (collective referred to herein as "printers") are used in a variety of different imaging applications. Various different architectures might be used for these systems. These architectures may depend on the particular methods used to transfer an image to a receiver material as well as the particular imaging mode(s) supported by the printer. While the examples herein may generally refer to printers, it should be understood that they may also apply to copiers, offset press systems, lithographic press systems and various other imaging systems.

They may also apply to other powder deposition systems, some of which may be capable of printing on metals. Powder deposition devices and techniques are discussed in co-pending U.S. Provisional Patent Application Ser. No. 60/551,464, titled "Powder Coating Apparatus and Method of Powder Coating Using an Electromagnetic Brush," filed on Mar. 9, 2004, which is commonly assigned, and which is incorporated herein by reference.

A printer may support imaging on one side of an image receiver material (e.g., simplex mode or simplex printing). The printer might additionally support synchronously imaging on both sides of the image receiving material (e.g., duplex mode or duplex printing). That is, the printer may make an image on one side of the receiver material, or the printer may make images on both sides of the receiver material. Printers may support one or both of these different printing modes.

In exemplary architectures, the printer can be a single pass printer. In this type of printer, the receiver material might only need to pass through the printer once in order to simultaneously image on the both sides of the receiver material. As discussed herein, various exemplary printers might employ architectures and methods that use a reduced number of internal steps in order to image on both sides of the receiver material. This might advantageously increase the speed with which the printer can perform duplex printing.

In one exemplary embodiment, the printer is a single pass, duplex mode printer that uses two insulating dielectric image receiving drums and two intermediate transfer drums, but the printer does not use any secondary transfer rollers. Implementing the system without secondary transfer rollers can advantageously reduce the number of steps needed to transfer an image to both sides of the receiver material, which can provide improved process speeds over conventional systems that use secondary transfer rollers or other such intermediate processing steps.

The printer might use various different types of intermediate transfer members, such as intermediate transfer drums. In one embodiment, the printer uses 2-up split intermediate transfer members. A 2-up split member generally has two separate portions that can be independently biased and that can carry separate images. While the two separate portions are generally halves of the 2-up split member, non-symmetric portions might also be used. The independent nature of the two portions allows them to be biased to different voltages. Thus, the two portions of one 2-up split member might be simultaneously biased to different voltages or to the same voltage.

Intermediate transfer members need not be limited to 2-up capability, 3-up or higher may be advantageously used depending upon the size of the drums or belts used in the architecture. Other embodiments might use intermediate transfer members that are not split members. A non-split intermediate transfer member generally comprises a single portion that is biased to one particular voltage. In other embodiments, combinations of 2-up split intermediate transfer rollers and non-split intermediate transfer rollers might be used.

The printer might use a variety of different methods to transfer images to the receiver material. For example, the printer might use various electrophotographic processes that employ toner or other magnetic carriers in order to create an image on one or both sides of the receiver material. Exemplary development systems that implement hard magnetic carriers are described in U.S. Pat. Nos. 4,473,029 and 4,546,060, the contents of which are incorporated by reference as if fully set forth herein. Other development systems implement magnetic carriers that are not hard (i.e. soft), and these may also be used. In these systems, the toning shell and/or toner magnet may or may not rotate, and other variations are also possible.

Directed aerosol toner development might alternatively be used to transfer the image to the receiver material. In directed aerosol toner development systems, a simple dielectric medium may be used in place of the photoconductor to receive charged particles directly comprising a latent image of charges on the surface. As an alternative, a real image of toner particles may be written directly on a suitable recording medium. In one particular embodiment, charged ions formed by the electrical breakdown of air may be written directly onto a suitable dielectric medium and subsequently developed with toner. In another embodiment, the real image on the imaging medium may be formed by projecting charged particles, such as toner particles.

Light is typically not required in directed aerosol toner development systems. Rather, an aperture print array can be used to directly create either a latent image of charged ions that can then be later developed with toner material or a real image of toner particles. Aperture print arrays typically include a plurality of front-to-back printing apertures formed through an insulating material, individually addressable control electrodes surrounding each printing aperture on one side, and a contiguous shield electrode on the other side. Thus, a flow of ions or toner particles to an image receiving member from an appropriate source of ions or toner in an electric field is image-wise modulated by the aperture print array.

In one embodiment, microelectronic photolithographic techniques can be used to apply one or more protective passivation layers onto the surface of the apertures in the aperture print arrays. This passivation layer can protect from contamination during assembly or use. Typical inorganic materials used for passivation layers are silicon dioxide ($SiO_2$) and silicon nitride ($Si_3N_4$). Other insulating passivation layers include phosphorus doped silicate glass ("PSG"), boron doped silicate glass ("BSC"), boron phosphorous doped silicate glass ("BPSC") and polysilicon ($Si_2$).

The passivation layer may be applied using chemical vapor deposition ("CVD") techniques. A variety of CVD techniques exist, for example, low temperature photochemical chemical vapor deposition ("LTPCVD"), low pressure chemical vapor deposition ("LPCVD"), and plasma enhanced chemical vapor deposition ("PECVD"). PECVD employs an rf-induced glow discharge to permit a low substrate temperature for substrates that lack thermal stability. The passivation layers may reduce or even prevent the effects of corrosive attacks by the various reactive molecular, ionic or other species that are created during the electrical breakdown of air.

In one embodiment, the printer might use a replaceable aperture print array. When the previously described effects degrade the performance of the printer below an acceptable level, the old aperture print array may be removed from the printer and replaced with a new aperture print array. Thus, the replaceable aperture print array might provide a simple and convenient method for maintaining the performance of the printer, such as its image quality and countering the effects of the reactive species.

In another embodiment, flexible membrane technology may be used to produce a flexible membrane aperture print array comprising a long continuous ribbon. The continuous ribbon may be indexed into position in a direct electrostatic printing or other device on demand. The ribbon may be indexed manually by a user of the printer, automatically by one or more components within the printer, or through a combination of manual and automatic methods. Also, a particular printer might support one or more of these methods for indexing the ribbon.

Flexible printed circuit boards ("PCBs") are one example of a flexible membrane technology that might be used to produce the aperture print array. Kapton may be used as a base laminate material in such flexible membrane circuits. Polyimide or polyesters may be used as the functional material in thicknesses between approximately 0.5 mil and 5.0 mil. Mylar and Kapton may be used as stiffeners for these structures. Typically, these types of PCBs are useable at operating temperatures between 0° C. to 60° C. and at relative humidities less than 90% RH. Additionally, these PCB structures may be stored at temperatures between −20° C. to 70° C., and they may withstand voltages >1000 v/mm and currents up to 5 mA. Operating life of over one million cycles are possible. It should be understood that these operational ranges are merely exemplary in nature, and other operational ranges might apply to a particular PCB.

Various conditions might be used to determine when to trigger the ribbon. For example, if toner clogging or other affects cause an unacceptable degradation in image quality, the ribbon may be indexed to remove the used section of the flexible aperture array and to replace it with a new section of the flexible aperture print array. The image quality might be measured based on one or more conditions, such as the reflection density of text or graphics, but other measures might also be used. Conditions other than image quality may alternatively be used to index the ribbon, and it is not necessary that the ribbon be indexed based on only one condition. Rather, two or more conditions might be used to independently or cooperatively determine when to index the ribbon.

Flexible aperture print arrays may be made using microelectromechanical systems ("MEMS") technologies. MEMS devices can be traced to silicon lithography invented for the microelectronics industry. Complex MEMS with moving parts are now constructed from silicon, ceramics, polymers, and other materials by multilayer lithographic and etching technologies. Emerging applications include sensors and actuators. MEMS devices such as pressure sensors and actuators may be assembled on flexible substrates using flip-chip-on-board ("FCOB") technology. FCOB technology is gaining widespread applications, and is described in more detail in John H. Lau, Low Cost Flip Chip Technologies, McGraw Hill, New York, 2000.

Flexible substrates may advantageously have a low-cost, mechanical flexibility and light weight. Flip-chip-on-flex ("FCOF") technology can be used in three dimensional packages and applications. The flexible film with mounted components can be bent and curved into flexible shapes.

In another embodiment, the flexible aperture print arrays may be made using inverted fabrication techniques. Thermal silicon oxide or Pyrex substrates are treated such that their surfaces are OH group terminated, allowing good adhesion between such substrates and spun-on polyimide film during processing through what are suspected to be hydrogen bonds that can be selectively broken when release is desired. This process may advantageously result in robust, low-cost and continuous polymer-film devices.

In another embodiment, flexible aperture print arrays may be made using integrated force array technology ("IFA"). IFAs can be flexible metalized membranes that are patterned using techniques of VLSI electronics, and which may undergo substantial deformation when voltage is applied. They may be configured as macroscopic actuators or valves, and they may be used in highly articulated systems. When voltage is applied, the membrane contracts in one dimension, producing large macroscopic motion with high efficiency. For example, the membrane might contact approximately 30% in one dimension. Thus, IFAs are a form of artificial muscle tissue controlled by an electrical voltage. These devices may have many different advantages, such as reduced power consumption, absence of sliding friction, operation under a wide range of external conditions, precise positioning capabilities and low weight. The ability to fully or partially close the aperture in an aperture imaging array offers the possibility of half-tone reproduction.

The IFA array structure may be constructed of polyimide, and may be robust enough to stand alone as an unsupported membrane yet flexible enough to allow the deformation. Thin chromium (e.g., 800 Angstroms) may be evaporated upon the polyimide as electrical vias, and conform to the polyimide during deformation without cracking. Chromium is preferred for its adhesion properties, although other materials might alternatively be used. The IFA cells are deformable capacitors in which the force between the plates is proportional to the plate area divided by the square of the separation.

IFA typically consume power only when they are moving. As the plates (e.g., apertures) close, the capacitance is increased, and in order to maintain constant voltage, the power source must supply current. For a resilient flexible structure, an inherent spring force acts against the capacitive force. This results in a stable equilibrium position that is continuously resolvable as a function of applied voltage. Very small shutters may be variably drawn across the aperture for each resolution element in the array. The shuttering is mechanical. These systems may enable self-cleaning functionality.

A number of implementations of IFA apertures are possible. A flexible shutter member containing an aperture interposed between two IFA members may be fabricated in such a way to close the imaging aperture. On activating an IFA on one end of the flexible shutter member, the shutter aperture may be moved to a position in line with the aperture print array, thereby opening the shutter. The IFA at the other end of the flexible shutter member acts as a spring force opposing the action of the first IFA. When the aperture print array is shut, the second IFA is activated, while the first IFA acts as a restraining spring force. Thus each aperture in the aperture print array may be independently opened and shut to permit the flow of charged particles or aerosol toner through the imaging array to the surface of the imaging member. This implementation is a spatial modulation in which the entire physical aperture in the aperture print array is opened or blocked.

Another implementation of this electromechanical shutter process draws a slit aperture across the physical aperture opening in the imaging aperture array. The slit aperture may be drawn across the physical aperture of the aperture print array at different velocities, thereby enabling half-tone capability. This corresponds to a temporal modulation of the aperture print array in which it is not necessary to completely open the physical aperture.

It may be advantageous to employ multiple layers of the flexible shutter members that operation orthogonally to one another. In other words, one slit aperture may operate in the X-Y plane, while another slit aperture may operate in the X-Z plane. This would enable the flow of charged particles or aerosol toner through the physical aperture print array to establish a gradient effect on the imaging receiver. It may also be advantageous to fabricate a slit aperture directly into the IFA itself.

Yet another embodiment for producing flexible aperture arrays is the use of a molecular self-assembly process called electrostatic self-assembly ("ESA"). This process produces thin film devices with material properties that can be precisely controlled. ESA may be used to produce materials with superior electrical, mechanical and optical properties. ESA can produce thin film materials with nanoscale-level molecular uniformity, which allows it to be an enabling technology for producing thin film aperture print arrays with precise control of physical properties. ESA is a simple, low cost, fabrication method that can be performed at room temperature and is generally environmentally benign. Multiple ESA material layers that are self-assembled by ionic bonding may be patterned by photolithography, UV laser irradiation, anisotropic etching, plasma etching and other methods to create large-scale integrated devices.

FIG. 1A is a block diagram of an exemplary double-sided image formation system in which images can be created on both sides of a receiver material in a single pass of the receiver material. The receiver material may be any type of receiver material, such as paper, overhead projector ("OHP") transparency materials, envelopes, mailing labels, and sheetfed offset or webfed offset preprinted shells, metals, metalized substrates, semi-conductors, fabrics or other materials. In this exemplary system, the receiver material is transported through the transfer station only once, and the image transfer to both sides of the receiver material occurs synchronously during this single pass. This can advantageously allow the system to maintain a relatively high process speed during duplex printing.

The particular architecture of the system may vary depending on the particular imaging process and the particular implementation of that imaging process used by the system. For example, this figure illustrates an exemplary drum architecture. However, other architectures such as a photoconductor belt, a continuous flexible seamless dielectric belt or still others might alternatively be used.

Figure 1B:
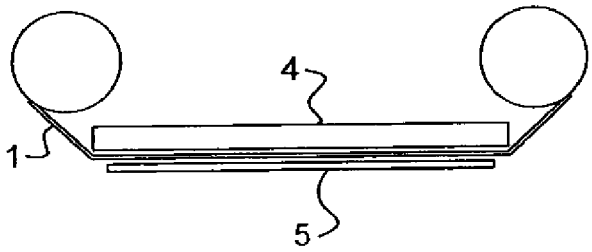
Figure 1C:
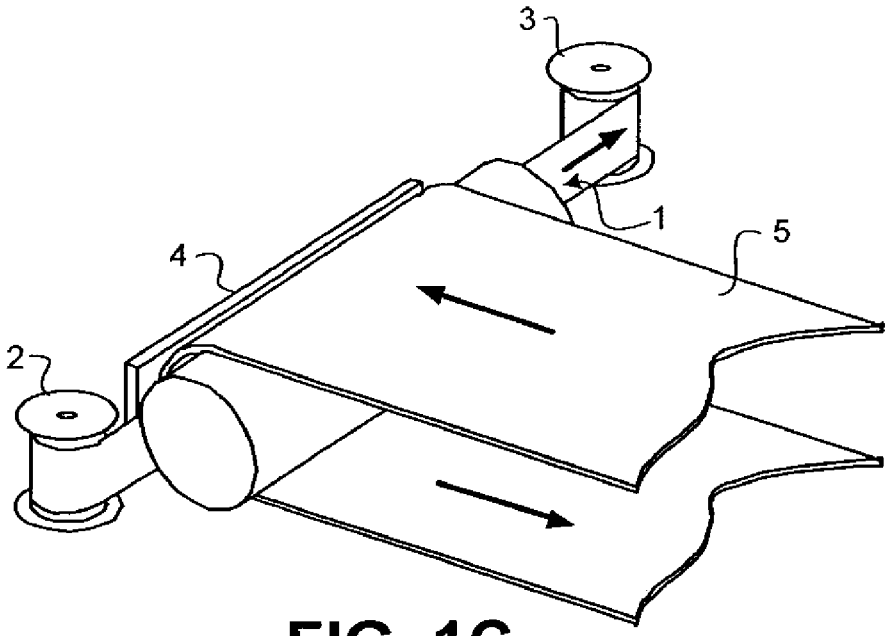
Figure 1D:
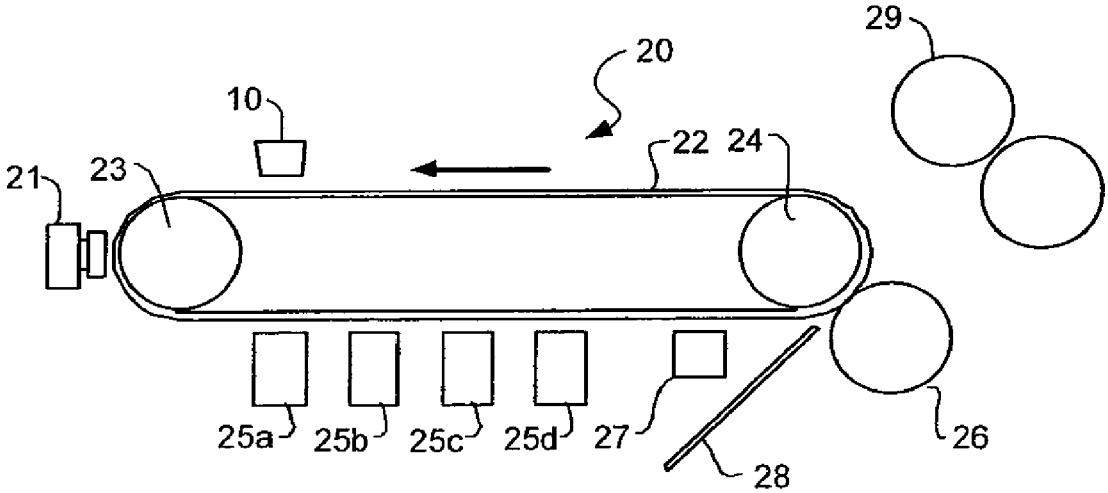

For example, FIG. 1D illustrates an exemplary belt architecture with a dielectric transfer medium. The belt architecture includes an aperture imaging array 21 that images changed ions, the dielectric belt 22, a belt racking roller 23, and a belt tracking roller 24. It further includes a plurality of toner development stations 25*a*, 25*b*, 25*c*, 25*d*. Each station 25*a*-25*d* might be used for a different color, such as cyan, magenta, yellow and black. Additionally depicted are a receiver substrate material feed roller 26, a pre-transfer corona device 27, receiver material 28, fuser assembly heater and pressure rollers 29, and an erase subsystem 10. Of course, these components are merely exemplary in nature, and some belt architectures might use different components.

FIG. 1C illustrates an exemplary replaceable flexible membrane aperture printing array system, such as might be used in either of the systems depicted in FIGS. 1A and 1D. As depicted in FIG. 1C, the system includes a replaceable flexible membrane aperture print array 1, a feed spool 2 for the replaceable flexible membrane aperture print array 1, a take up spool 3 for the replaceable flexible membrane aperture print array, an ion or aerosol toner source 4, and an intermediate transfer member 5. FIG. 1B illustrates an alternate view of the replaceable flexible membrane aperture printing array system of FIG. 1C. All the components retain their same labels.

Returning to FIG. 1A, the system includes two imaging members. These two imaging members are labeled I#1 and I#4 respectively. The imaging members might vary depending on the particular imaging processes. If the system uses an electrophotographic process, then the two imaging members might be photoconductors. However, if the system uses a direct electrostatic printing process, then the imaging members might not be photoconductors but rather might be insulating dielectric surfaces or some other imaging member appropriate for that process.

The system also includes two intermediate transfer members, which are labeled IT#2 and IT#3 respectively. Each imaging member works together with its respective intermediate transfer member to image on one side of the receiver material. The first imaging member I#1 and the first intermediate transfer member IT#2 image on the first side of the receiver material, while the second intermediate transfer member IT#3 and the second imaging member I#4 image on the other side of the receiver material.

Real toner images are formed on two separate image rollers I#1, I#4 with insulating dielectric surfaces, as is illustrated in FIG. 1. Dry toner images on the surfaces of I#1 and I#4 are transferred to the intermediate transfer members IT#2, IT#3. The first intermediate transfer member IT#2 also serves as a backup roller for the second intermediate transfer roller IT#3 in the paper transfer nip. And, the second intermediate transfer member IT#3 serves as the backup roller for the first intermediate transfer member IT#2 at the same receiver material transfer nip location.

The process speed is generally determined from the surface speed of the intermediate transfer members IT#2, IT#3. The intermediate transfer members IT#2, IT#3 preferably operate at the same velocity, and the image members I#1, I#4 in turn preferably have the same velocity as the intermediate transfer members IT#2, IT#3. That is, all four members preferably rotate at the same velocity.

In one preferred embodiment, the imaging members I#1, I#4 are 2-up rollers that have distinct electrically contiguous surfaces made of an insulating dielectric material, and the intermediate transfer members IT#2, IT#3 are also 2-up split rollers. The total surface area of the roller is split or separated into two equal areas with distinct and electrically isolated regions. One half of each cylindrical roller may be biased to one voltage value, while the other half may be biased to a different voltage. Thus, the voltages of the two halves of one roller may be the same or different.

Toner images on the split surfaces of the two intermediate transfer members IT#2, IT#3 can undergo synchronous transfers to the receiver material. For example, the toner images on one of the split surfaces of the first intermediate transfer member IT#2 can be transferred under the influence of an electric field to one side of the receiver material. The toner image on one of the split surfaces of the second intermediate transfer member IT#3 can be synchronously transferred to the other side of the receiver material through another electric field. Thus, the two intermediate transfer members IT#2, IT#3 can form a single toning nip that is used to image on both sides of the receiver material.

The double-sided transfer of toner images from the 2-up image members I#1, I#4 to the 2-up split intermediate transfer members IT#2, IT#3 and finally to both sides of the receiver material can operate at the full process speed capability of the printer, since the 2-up split intermediate transfer members IT#2, IT#3 are not required to temporarily transport the image frame for a second cycle in order to synchronize the transfer of the two images. Also, the synchronous transfer of images to both sides of the receiver material in a single transfer nip defined by the contact of the two image transfer members advantageously does not require more than one transfer station.

I. Example 1

Hybrid Split Roller Duplex Printing Using Directed Aerosol Toner Development

This example illustrates an exemplary four-roller system for duplex printing that uses directed aerosol toner development. In this exemplary embodiment, the intermediate transfer members IT#2, IT#3 are 2-up split rollers whereas the imaging rollers are not split rollers. It should be noted that systems employing split imaging and split transfer rollers are also possible.

Each different region of the rollers might carry a different dc voltage. The particular dc voltages are selected to allow development of negatively charged toner onto the surface of the imaging rollers I#1, I#4. The dc voltages are also selected to allow the transfer of negatively charged toner onto the surfaces of the 2-up split intermediate transfer rollers IT#2, IT#3. A dc bias voltage is applied to the appropriate regions of the 2-up split intermediate transfer rollers IT#2, IT#3. This permits the synchronous duplex transfer of the toner on the split surfaces of the intermediate transfer rollers IT#2, IT#3 onto both sides of a receiver material passing through a single nip formed between the intermediate transfer rollers IT#2, IT#3.

The system may use different cycles, such as image and transfer cycles, to image onto the receiver material. Exemplary cycles for this system are described in more detail below and with reference to FIGS. 2-4, which illustrate preferred biases that might be used during the respective cycles. The solid black arrows generally located within the rollers show the electric field vectors corresponding to the particular biases, while the thinner black arrows generally located around the rollers show the direction of physical rotation of the rollers.

A. Cycle 1—Image Cycle

Figure 2:
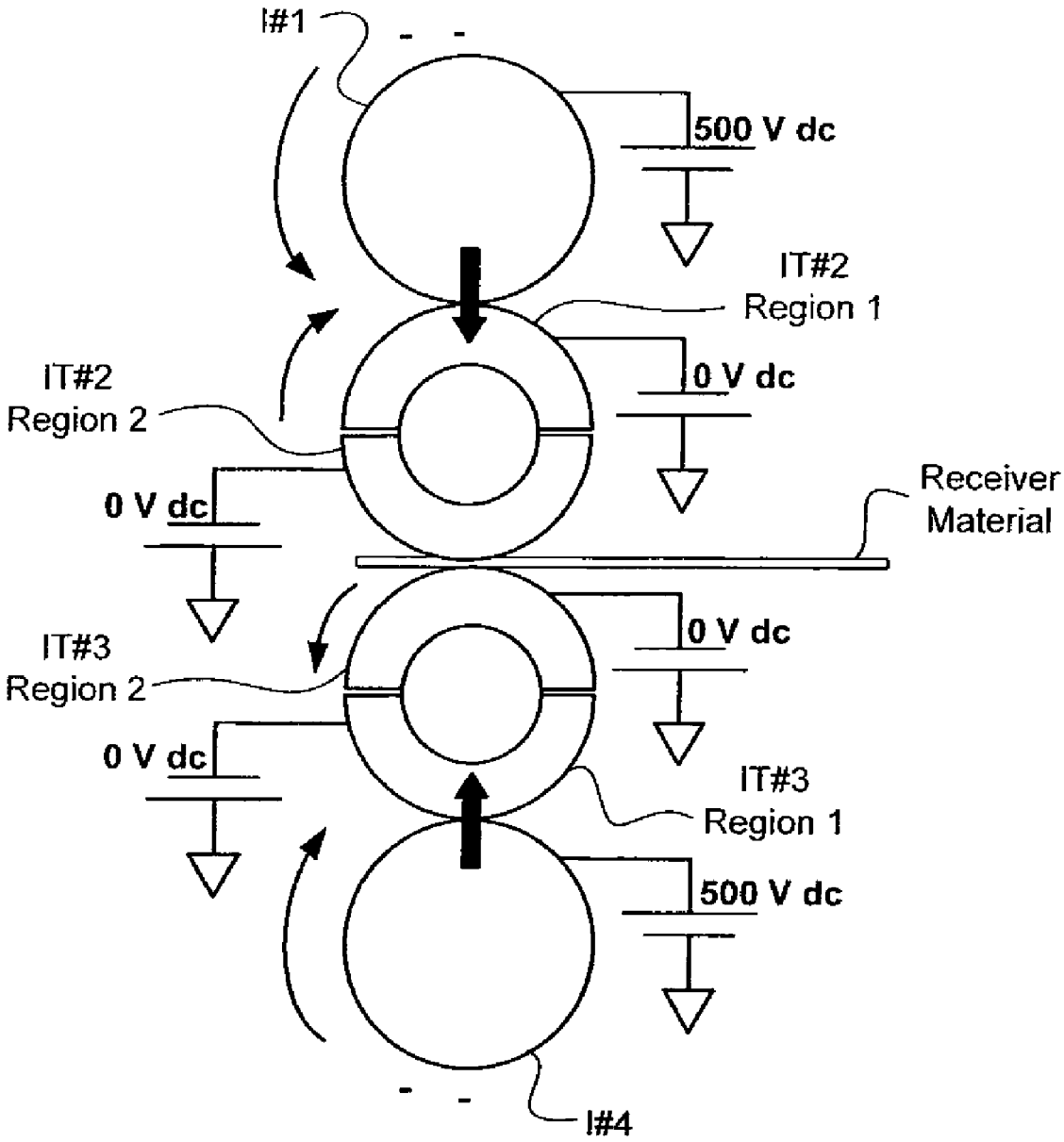
FIG. 2 illustrates an exemplary imaging cycle for a hybrid split roller imaging system using directed aerosol toner development.

FIG. 2 illustrates an exemplary imaging cycle for a hybrid split roller imaging system using directed aerosol toner development. During the imaging cycle, negative toner is imaged onto the surface of both imaging rollers I#1, I#4 using directed aerosol toner development. An aperture array print head can be modulated to write directly onto the insulating dielectric surfaces in an image-wise fashion. The electrical substrates of the imaging rollers I#1, I#4 are preferably biased to +500 V dc to provide an electric field near the surface to attract and hold the negative toner. The 2-up split intermediate transfer rollers IT#2, IT#3 both have the electrically conducting substrates for all their distinct regions preferably biased to 0 V.

In this example, all voltages are with respect to ground, which is 0 V dc. However, it should be understood that the different rollers in this or other examples might be biased with respect to voltages other than ground. Also, the particular biases described in this and the other examples are merely exemplary in nature, and other biases might also be used.

B. Cycle 2—Transfer to Intermediate Transfer Roller

Figure 3:
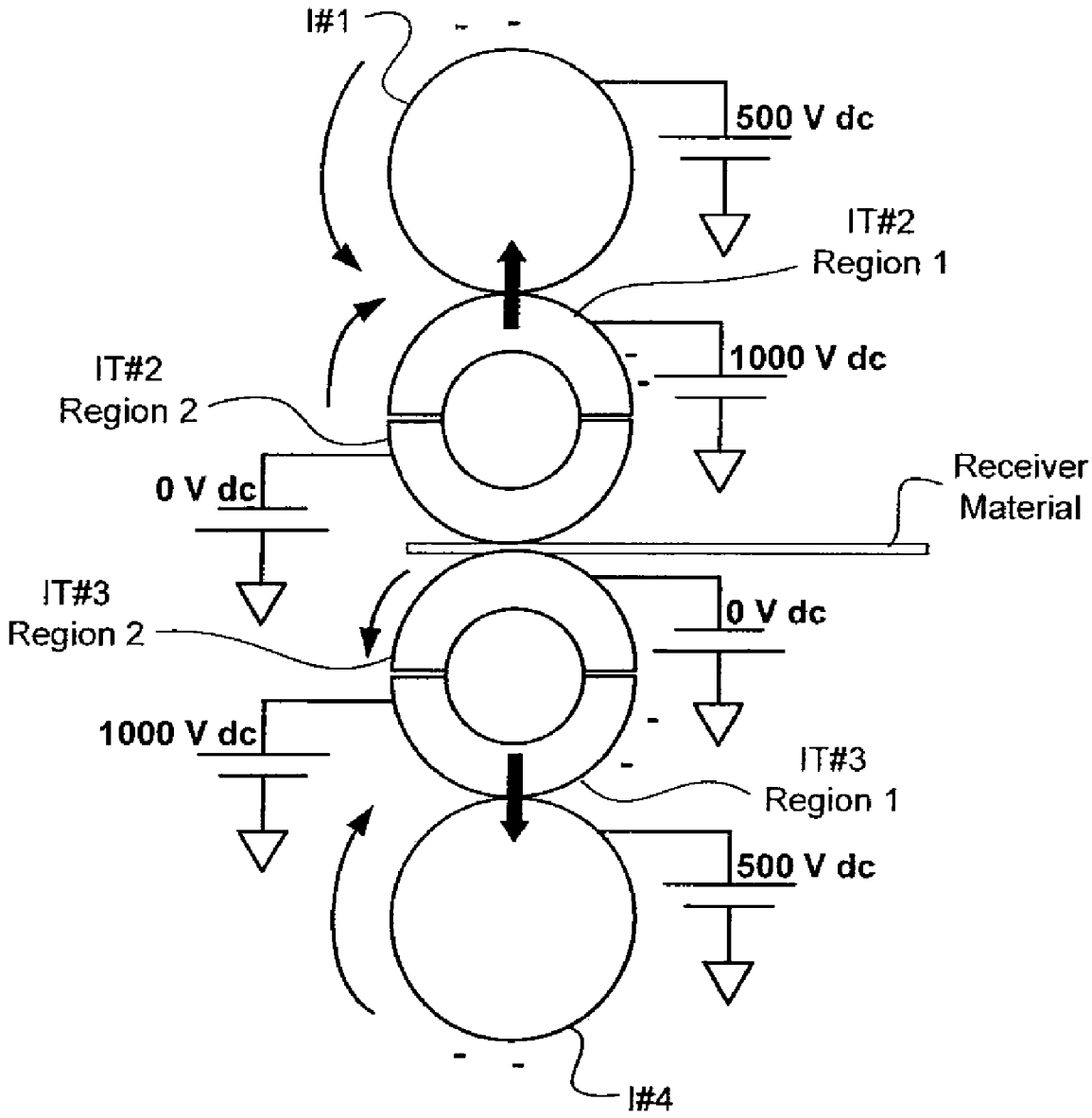
FIG. 3 illustrates an exemplary first transfer cycle for a hybrid split roller imaging system using directed aerosol toner development.

FIG. 3 illustrates an exemplary first transfer cycle for a hybrid split roller imaging system using directed aerosol toner development. In this transfer cycle, negative toner on the imaging rollers I#1, I#4 is transferred to region 1 of each respective 2-up split intermediate transfer member IT#2, IT#3. The electrically conducting substrate for region 1 of each 2-up split intermediate transfer member IT#2, IT#3 is preferably biased to +1000 V dc.

At the same time, the electrically conducting substrate of region 2 of each 2-up split intermediate transfer member IT#2, IT#3 is biased to 0 V dc. This creates an electric field gradient between region 1 of the 2-up split intermediate transfer rollers IT#2, IT#3 and their respective imaging rollers I#1, I#4. The electric field gradient enables the negatively charged toner to leave the imaging rollers, I#1, I#4 and move to the surface of the 2-up split intermediate transfer members IT#2, IT#3. During this transfer cycle, a new image is then transferred to the other frame of the 2-up split intermediate transfer members IT#2, IT#3.

C. Cycle 3—Transfer of Toner to Receiver

Figure 4:
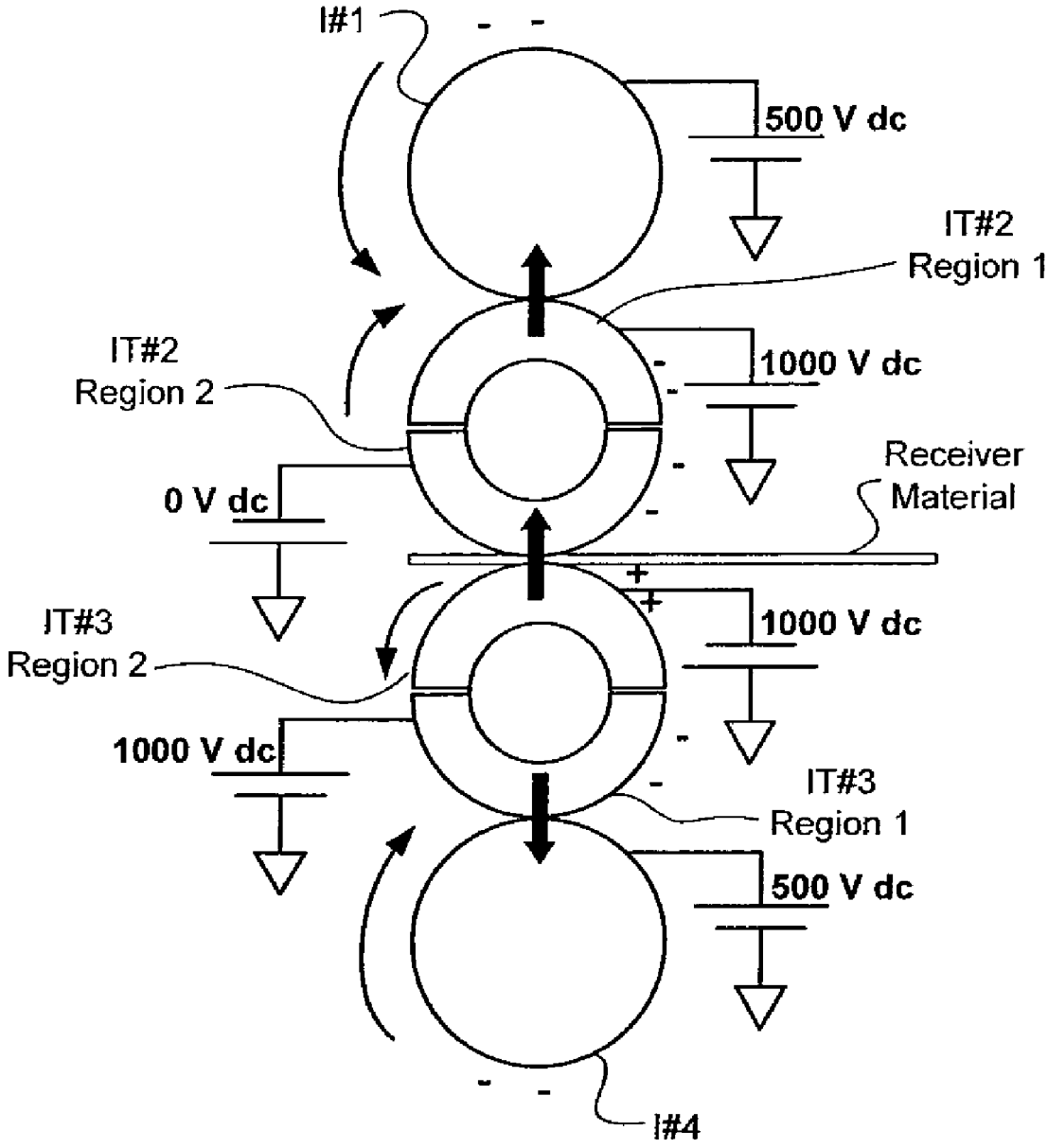
FIG. 4 illustrates an exemplary second transfer cycle for a hybrid split roller imaging system using directed aerosol toner development.

FIG. 4 illustrates an exemplary second transfer cycle for a hybrid split roller imaging system using directed aerosol toner development. During this transfer cycle, negative toner on region 2 of the first intermediate transfer roller IT#2 is transferred to one side of the receiver material in the transfer nip formed between the 2-up split intermediate transfer rollers IT#2, IT#3. Also during this cycle, the negative toner on region 2 of the second intermediate transfer roller IT#3 is charged positively with a suitable polarity changing device, such as a corona wire charging device. The positive toner on region 2 of the second 2-up split intermediate transfer member IT#3 is transferred to a second side of the receiver material synchronously with the transfer of the negative toner to the first side of the receiver material.

Also during this cycle, the conducting substrate of region 2 of the first 2-up split intermediate transfer roller IT#2 is biased to 0 V dc. At the same time, region 2 of the second 2-up split intermediate transfer roller IT#3 is biased to +1000 V dc. This establishes an electric field across the nip between the first and second 2-up intermediate transfer rollers IT#2, IT#3 that contains the receiver material. The negatively changed toner moves in this electric field to the top of the receiver material, while the positive toner moves under the influence of the electrical field to the bottom of the receiver material.

One additional cycle, cycle 4, can be used to create two duplex pages with four images contained on their first and second sides. This cycle would then be a repeat of cycle 3.

D. Exemplary Biasing Effects

In Imaging Cycle 1, a 500 V dc bias is applied to the core of the imaging rollers I#1, I#4 to hold the real toner image created by the directed aerosol toner development process. During Transfer Cycle 2, a 500-volt difference exists between the imaging rollers I#1, I#4 and regions 1 of 2-up split intermediate transfer rollers IT#2, IT#3. The voltage difference causes the negatively charged toner on the surfaces of the imaging rollers I#1, I#4 to transfer to the surface of regions 1 of the 2-up split intermediate transfer rollers IT#2, IT#3.

During Transfer Cycle 3, a 1000-volt difference is created between regions 2 of the 2-up split intermediate transfer rollers IT#2, IT#3. A 0 V dc bias is applied to region 2 of the first 2-up split intermediate transfer roller IT#2, while at the same time a +1000 V dc bias is applied to region 2 of the second 2-up split intermediate transfer roller IT#3. The electric field enables the negatively charged toner on the surface of the first 2-up split intermediate transfer roller IT#2 to transfer to one side of the receiver material in the nip between the two 2-up split intermediate transfer rollers IT#2, IT#3. The positive charged toner on the surface of the second 2-up split intermediate transfer roller IT#3 is transferred to the other side of the receiver material under the influence of the electric field across the receiver material in the nip between the two 2-up split intermediate transfer rollers IT#2, IT#3.

One advantage of this implementation is that only one kind of toner needs to be used in identical directed aerosol development systems to develop the negative toner onto the surfaces of the imaging rollers I#1, I#4. Controlling the voltage bias on the individual rollers may be easier than using two different toners (e.g., a negatively and a positively charged toner) and the different development systems that would be required to support those different types of toners.

II. Example 2

Synchronous Duplex Printing Using Directed Aerosol Toner Development

In this example the intermediate transfer rollers IT#2, IT#3 are single-section rollers rather than the 2-up split rollers of the previous example. Each of the different rollers can be biased to a particular dc voltage. The dc voltages are selected to permit the development of negatively charged toner onto the surface of imaging rollers I#1, I#4 and are also selected to enable the transfer of the negatively charged toner onto the surface of the intermediate transfer rollers IT#2, IT#3. The selected voltages also enable the synchronous duplex transfer of the toner on the surface of the intermediate transfer rollers IT#2, IT#3 onto both sides of the receiver material passing through the nip.

A. Cycle 1—Image Cycle

Figure 5:
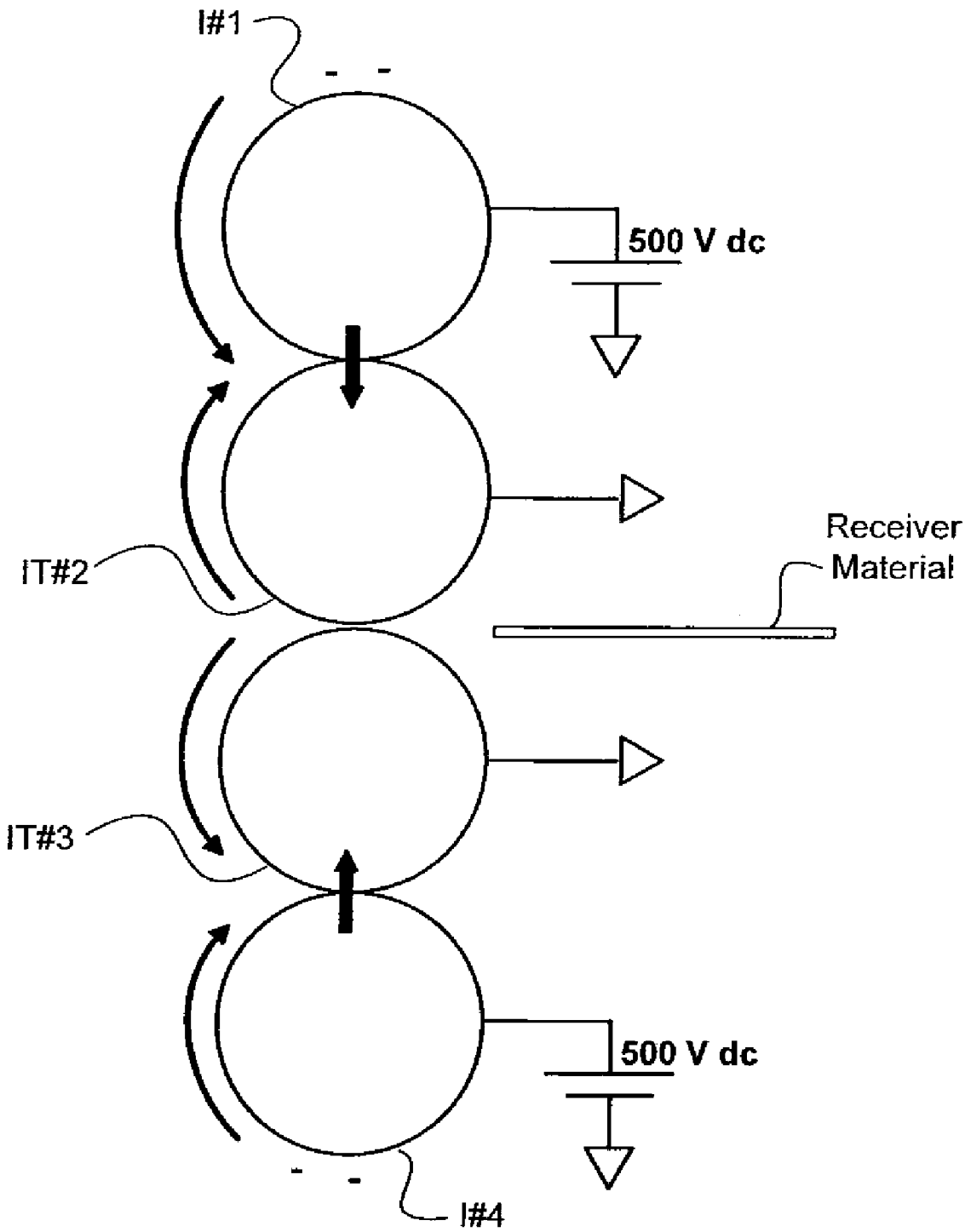
FIG. 5 illustrates an exemplary image cycle for synchronous duplex printing using directed aerosol toner development.

FIG. 5 illustrates an exemplary image cycle for synchronous duplex printing using directed aerosol toner development. In the imaging cycle, a 500 V dc bias is applied to the core of both imaging rollers I#1, I#4 so as to hold the real toner image created by the directed aerosol toner development process. Both intermediate transfer rollers IT#2, IT#3 are biased to 0 V dc.

B. Cycle 2—First Transfer Cycle

Figure 6:
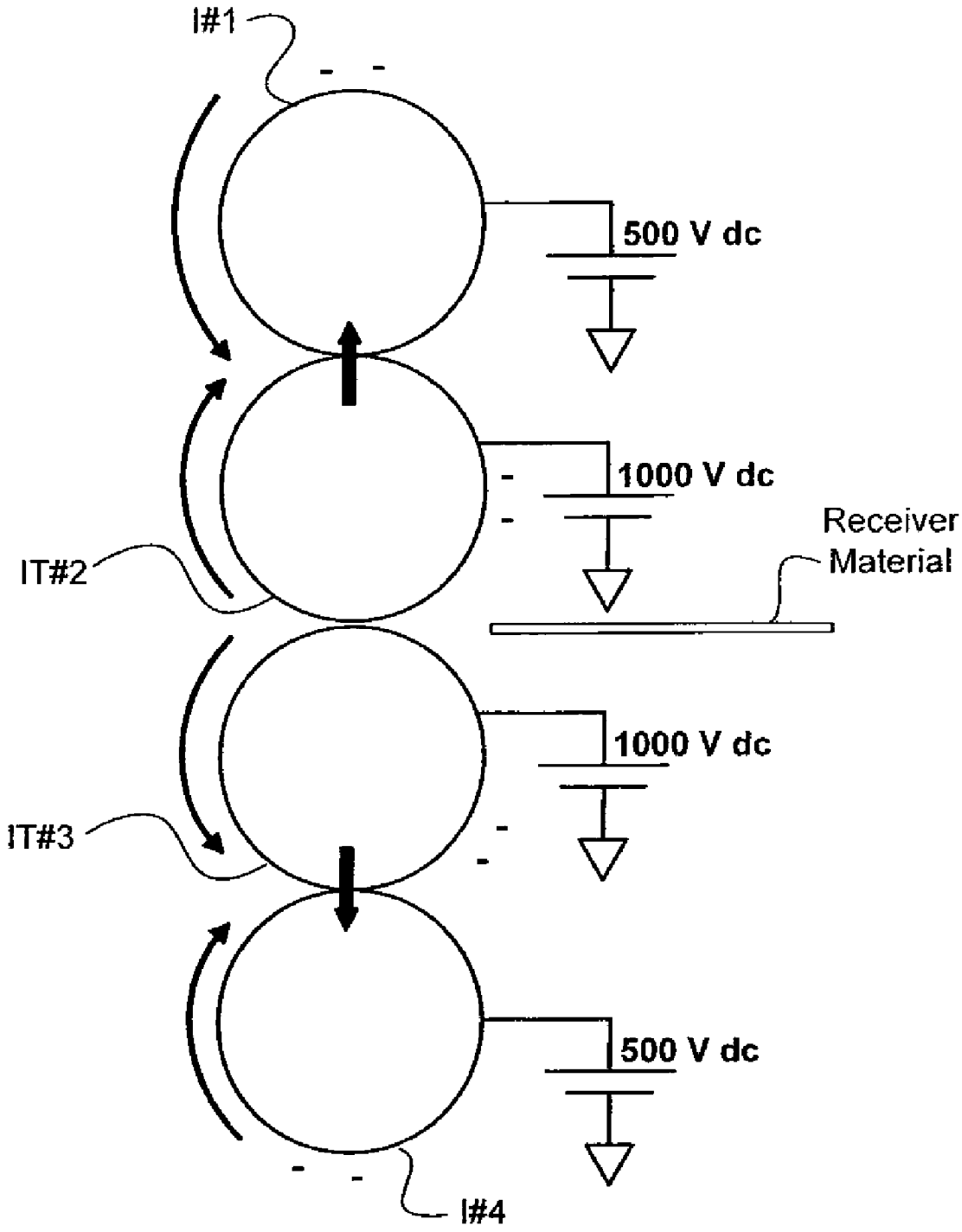
FIG. 6 illustrates an exemplary first transfer cycle for synchronous duplex printing using directed aerosol toner development.

FIG. 6 illustrates an exemplary first transfer cycle for synchronous duplex printing using directed aerosol toner development. During the first transfer cycle, both imaging rollers I#1, I#4 are biased to 500 V, while both intermediate transfer rollers IT#2, IT#3 are biased to 1000 V. This creates a 500 V difference between the intermediate transfer rollers IT#2, IT#3 and their respective imaging rollers I#1, I#4. This voltage difference enables the negatively charged toner on the surface of the imaging rollers I#1, I#4 to transfer to the surface of the intermediate transfer rollers IT#2, IT#3.

C. Cycle 3—Second Transfer Cycle

Figure 7:
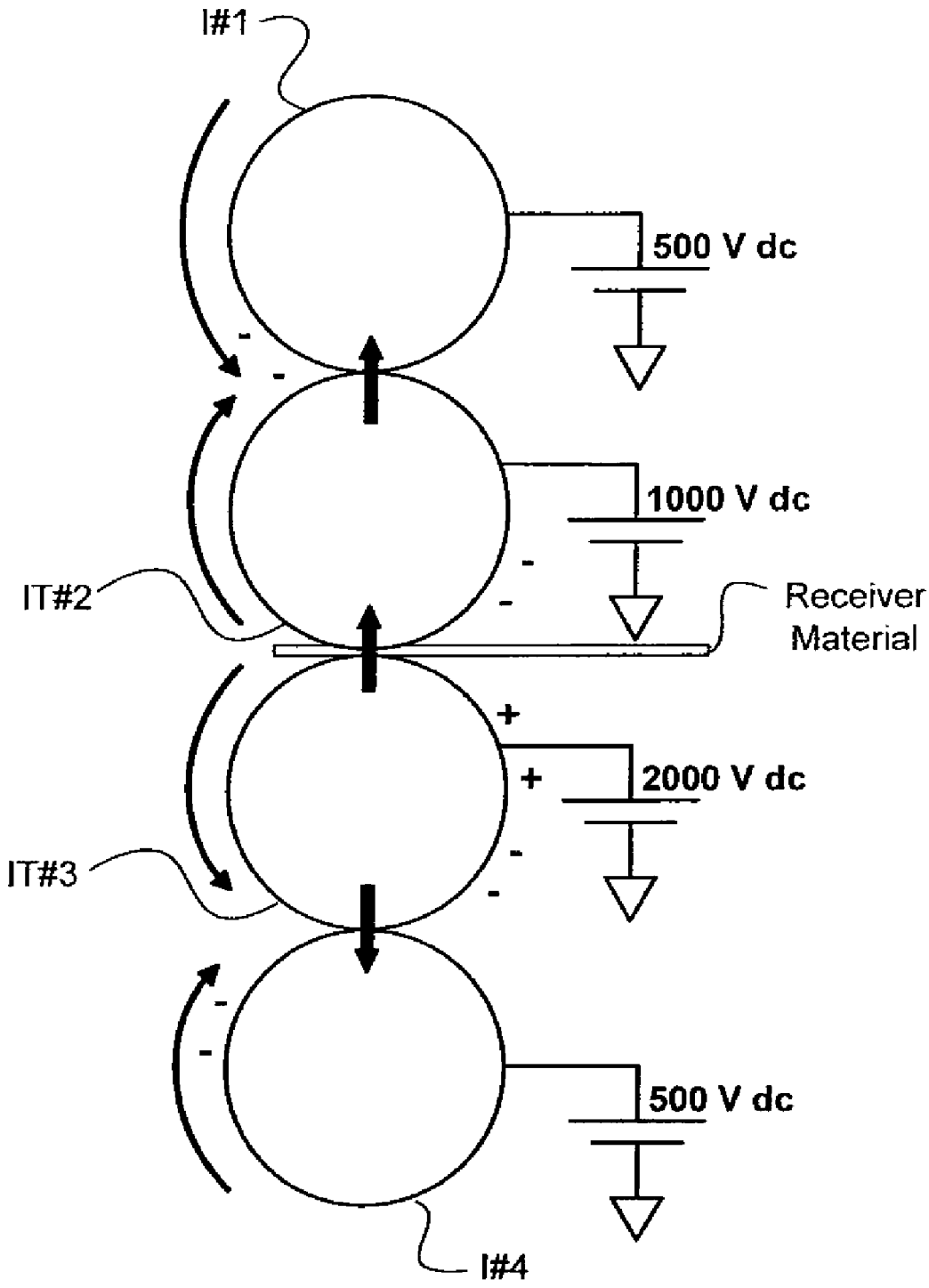
FIG. 7 illustrates an exemplary second transfer cycle for synchronous duplex printing using directed aerosol toner development.

FIG. 7 illustrates an exemplary second transfer cycle for synchronous duplex printing using directed aerosol toner development. During the second transfer cycle, both imaging rollers I#1, I#4 are biased to 500 V, the first intermediate transfer roller IT#2 is biased to 1000 V, and the second intermediate transfer roller IT#3 is biased to 2000 V. The biasing creates a 1000 V difference between the intermediate transfer rollers IT#2, IT#3, and the voltage difference establishes an electric field between the two intermediate transfer rollers IT#2, IT#3. The electric field enables the negatively charged toner on the surface of the first intermediate transfer roller IT#2 to transfer to one side of the receiver sheet in the nip between the intermediate transfer rollers IT#2, IT #3. At the same time, the positively charged toner on the surface of the second intermediate transfer roller IT#3 is transferred to the other side of the receiver sheet under the influence of the electric field across the receiver sheet in the nip.

A corona device, or another suitable polarity changing device, may be employed to change the charge on the negative toner on the surface of the second intermediate transfer roller IT#3 to a positive charge. This must generally occur prior to the arrival of the toner on the surface of the second intermediate transfer roller IT#3 to the nip.

As with the prior example, the embodiment advantageously only requires one kind of toner rather than, for example, both positively and negatively charged toners along with their respective development systems.

III. Example 3

Opposite Polarity System with Intermediate Transfer Rollers

Synchronous duplex with the use of split-rollers has the advantage of permitting the use of a single polarity charged particle or type of toner or other charged material. It is also possible that the charged particles on each side of the system may in fact be different materials but of the same polarity. This might happen, for example, in the case where a black toner is placed on one side and a color toner placed on the other side.

The use of a single polarity toner or particle may be accomplished by changing the polarity of the particle on one side of the system, after placement but before transfer to the receiver, combined with the use of a split roller where the voltage bias level for the section of the intermediate transfer roller containing the charged particle is changed just prior to contacting the receiver. The change in voltage bias serves to encourage movement of the changed polarity particle to one side of the receiver while also encouraging the movement of the unchanged polarity particle from the alternate side of the system to the other side of the receiver.

The disadvantage of using a single polarity or type of toner results in increased hardware complexity. A charging mechanism or structure to change the polarity of the particle must be added to the system, and there is increased complexity inherent in the manufacture and design of a split roller. Furthermore, because the electrically isolated sections of the transfer rollers are a fixed size, it is not possible to use receivers that are larger than the isolated transfer roller sections or to run receivers smaller than the size of isolated transfer roller sections without loss of maximum throughput productivity. If smaller receivers are used, they cannot be fed end to end for maximum productivity, rather they must be fed in such a manner to correspond to the isolated sections of the intermediate transfer roller. Therefore, simultaneous duplex with toners or charged particles of opposite polarity may often be preferred. Two examples using opposite polarity particles follow.

This example illustrates an exemplary four-roller system for duplex printing that uses directed aerosol toner development of opposite polarity particles. In this example none of the rollers are split rollers. Each roller carries a different dc voltage which are selected to allow development of the charged toner or charged particle onto the surface of the imaging dielectric rollers I#1, I#4. The dc voltages are also selected to allow the transfer of negatively charged toner onto the surfaces of the intermediate transfer rollers IT#2, IT#3 while also establishing the electric field necessary to enable synchronous duplex transfer the toner onto both sides of a receiver material passing through a single nip formed between these same intermediate transfer rollers.

Typically in electrophotographic systems, development electrodes are biased to create a field within which toner or other charged particles are forced or attracted toward the imaging surface. The difference in bias on the development electrode and the "toned" or imaged surface is typically referred to as the toning potential and is on the order of 100-500 volts. The specific voltage is typically a function of the spacing between elements where tighter spacing results in higher fields, and of the charge to mass of the toner. A highly charged particle is some ways more "controllable" however, for proper imaging characteristics a given mass of toner must also be present. Higher charge for fixed field strength results in lower mass placement. The voltage is also typically a function of the constraint of breakdown of air between the electrode and the imaging surface, often referred to as the Paschen limit. High voltage across small spaces can breakdown the air and discharge locally thereby preventing a field from being maintained. Development electrodes may commonly be biased between ±500 V to ±1500 V.

Transfer voltages are often constrained by the Paschen limit of air breakdown that can cause ionization in the nip region of the roller thereby disrupting the image. This is the reason why roller transfer systems are often coated with a material of controlled electrical resistivity. If the electrical resistivity is too high, a field cannot be built up and no transfer will occur. If the electrical resistivity is too low, a field will build up very quickly and often result in "pre-nip" ionization.

Similarly, transfer voltages from roller to roller or roller to receiver are determined by the level necessary to establish a suitable field to move the charged particle and are typically higher than the voltages used in development. These can be in the region from ±500 V to ±3000 V. The field strength needed is often a function of the distance over which the field is operating. If transferring onto both sides of a paper receiver the total distance can be the thickness of the toner on both sides of the receiver and the paper itself. If transferring to metal, the relevant distance may only be the thickness of the particles themselves because the metal can be treated as a grounded conductor.

The electric field required for the charged particle may be changed by modifying the physical properties of the particle. For example, surface treated particles tend to be more fluid and free flowing. As a result the field required to move these particles can be lower than non-surface treated materials. These any various other operation factors might be taken into account in determining the particular voltages to be applied to an imaging system. Therefore, it should be understood that the particular voltages describe in all the examples herein are merely exemplary in nature.

Exemplary cycles for this system are described in more detail below with reference to the corresponding figures, which illustrate example biases that might be used during the respective cycles. The solid black arrows generally located within the rollers show the electric field vectors corresponding to the particular voltage biases, while the thinner black arrows generally located around the rollers show the direction of physical rotation of the rollers.

A. Cycle 1—Image Cycle

Figure 8:
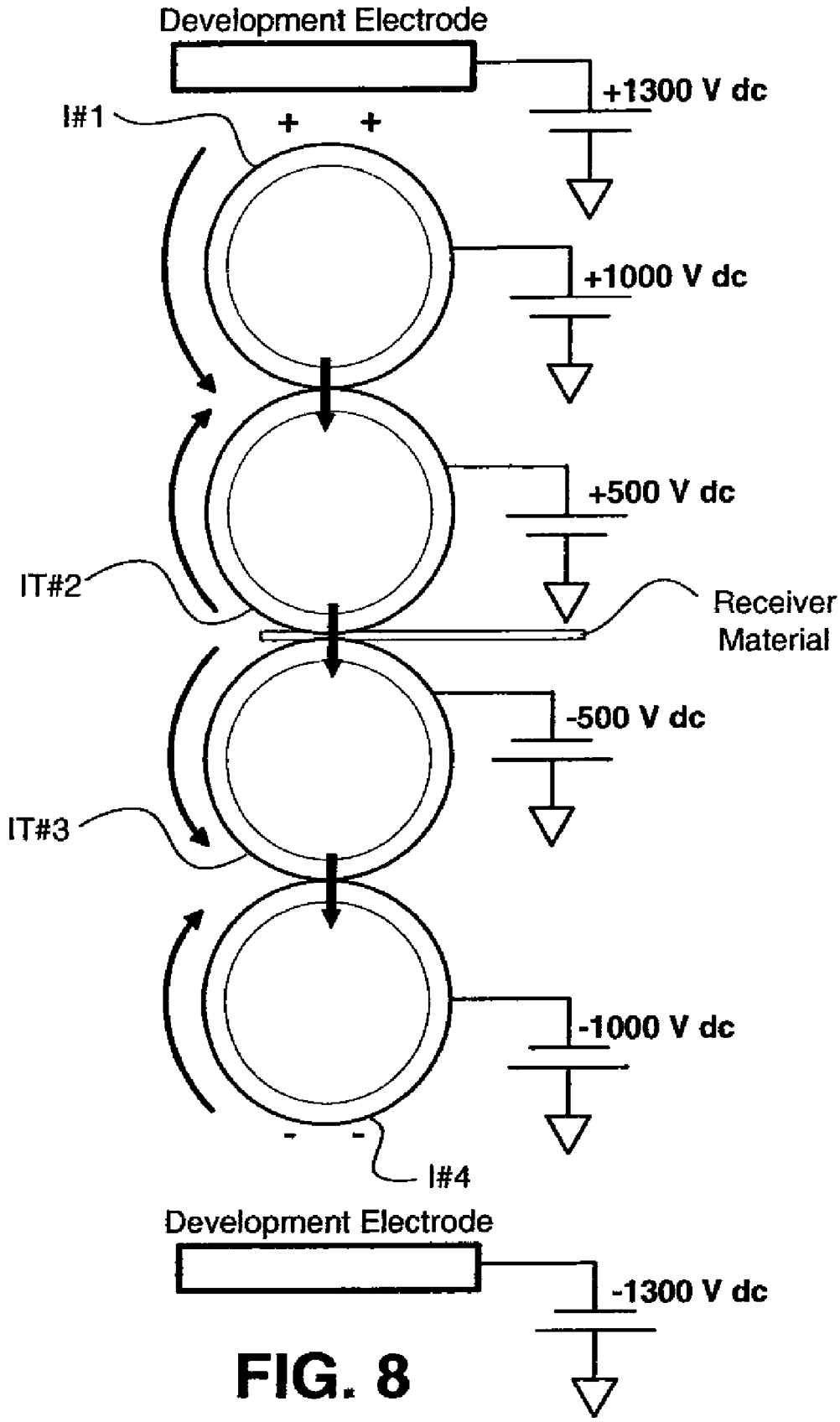
FIG. 8 illustrates an exemplary imaging cycle for a four-roller system for duplex printing that uses directed aerosol toner development of opposite polarity particles.

FIG. 8 illustrates an exemplary imaging cycle for a four-roller system for duplex printing that uses directed aerosol toner development of opposite polarity particles. During the imaging cycle, negatively charged particles are placed on the second imaging dielectric roller I#4 and positively charged particles are placed on the first imaging dielectric roller I#1 using aerosol toner development. An aperture array print head can be modulated to write directly onto the insulating dielectric surfaces in an image-wise fashion. The electrical substrates are biased to −1000 V and +1000 V dc respectively to provide an electric field near the surface to attract and hold the negative and positive particles.

In this case, the development electrode is biased at +1300 V dc to encourage the positively charged particles to move to the lower potential Imaging Roller #1 surface at +1000 V dc. Similarly, a second development electrode is biased at −1300 V dc to drive placement of the negatively charged particles on Imaging Roller #4 at −1000 V dc.

In this example all voltages are with respect to ground, which is 0V dc. However, it should be understood that the different rollers in this or other examples might be biased with respect to voltages other than ground. Also, the particular voltage biases described in this and the other examples are merely exemplary in nature, and other voltage biases might also be used.

B. Cycle 2—Transfer to Intermediate Transfer Roller

Figure 9:
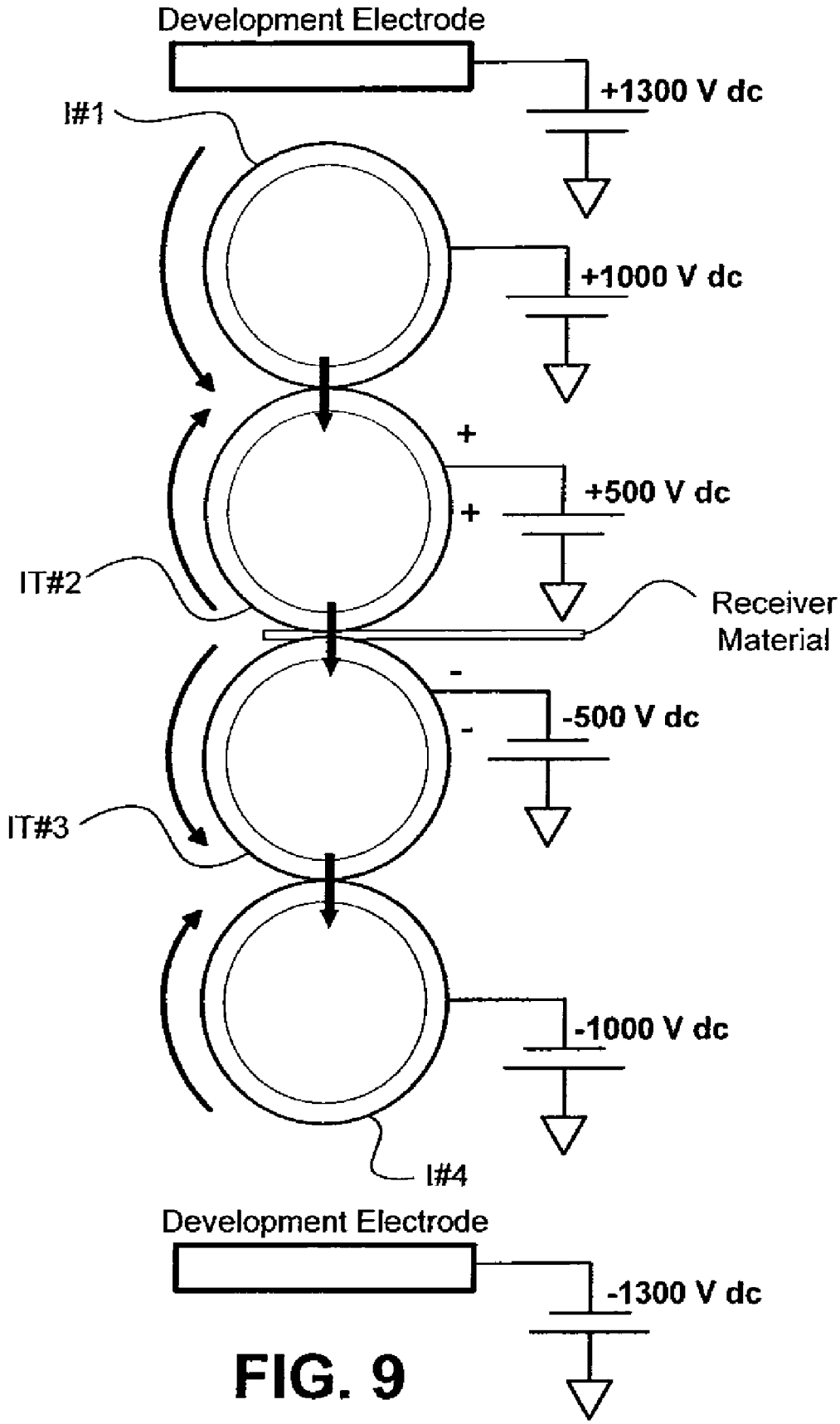
FIG. 9 illustrates an exemplary imaging cycle for a four-roller system for synchronous duplex printing that uses directed aerosol toner development of opposite polarity particles.

FIG. 9 illustrates an exemplary imaging cycle for a four-roller system for synchronous duplex printing that uses directed aerosol toner development of opposite polarity particles. The voltage biases on all rollers remain the same as the previous cycle. As in the previous cycle, the intermediate transfer members IT#2 and IT#3 are biased to +500 V and −500 V dc respectively to provide an electric field near the surface to attract and hold the positive and negative particles to the intermediate transfer rollers.

In this transfer cycle, a positive charged particle is transferred from the first imaging member IT#1 to the first intermediate transfer roller IT#2 while a negative charged particle is transferred from the second imaging member IT#4 to the second intermediate transfer roller IT#3. The intermediate transfer rollers IT#2, IT#3 might typically be biased using the same voltage polarity as their respective imaging rollers, but to a lesser magnitude to establish a suitable electric field for particle transfer. During this transfer cycle an image can continue to be written on IT#1, IT#4 indefinitely.

C. Cycle 3—Transfer of Toner to Receiver

Figure 10:
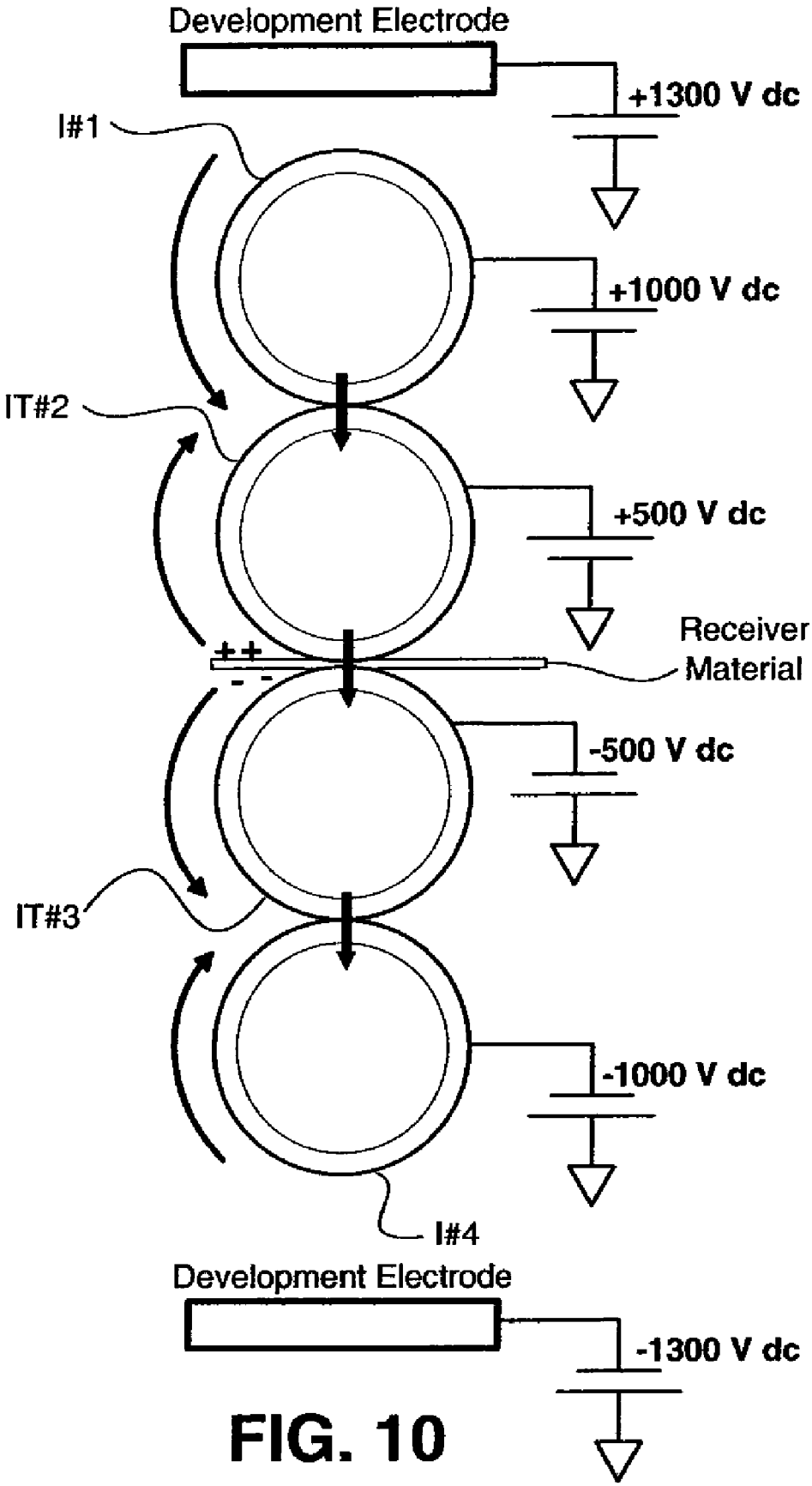
FIG. 10 illustrates an exemplary imaging cycle for a four-roller system for synchronous duplex printing that uses directed aerosol toner development of opposite polarity particles.

FIG. 10 illustrates an exemplary imaging cycle for a four-roller system for synchronous duplex printing that uses directed aerosol toner development of opposite polarity particles. The voltage biases on all rollers remain the same as in the previous cycles.

In this transfer cycle, a positive charged particle is transferred from the first intermediate transfer member IT#2 to one side of the receiver by the field between the intermediate transfer members IT#2, IT#3. Synchronously, a negative charged particle is transferred from the second intermediate transfer member IT#3 to the other side of the receiver by the electric field between the intermediate transfer members IT#3, IT#2.

In cases where the receiver is conductive, as with metal, it can be grounded to create a suitable electric field between the first intermediate transfer member IT#2 and the metal and between the second intermediate transfer member IT#3 and the metal. The bulk and surface resistivity of the compliant material on the intermediate transfer members IT#2, IT#3 is preferably chosen to have appropriate characteristics. If the resistivity is too low, current will simply be conducted to ground in the metal resulting in no field. During this transfer cycle an image can continue to be written on the imaging members IT#1, IT#4 while also transferring from the first imaging member IT#1 to the first intermediate transfer member IT#2 and from the second imaging member IT#4 to the second intermediate transfer member IT#3 indefinitely.

IV. Example 4

Opposite Polarity System without Intermediate Transfer Rollers

Additionally, when dealing with dielectric rollers it is possible to consider eliminating the intermediate transfer step. This may require that the rollers be compliant in nature and may be coated or manufactured with a material with suitable dielectric properties while still having the appropriate mechanical wear properties to protect it from the receiver. This places additional demand on the materials design and selection but simplifies the hardware architecture further. In the previous examples, for instance, the imaging dielectric rollers IT#1, IT#4 might be hard for extreme durability while the intermediate transfer rollers IT#2, IT#3 might only be compliant with suitable resistivity.

A. Cycle 1—Image Cycle

Figure 11:
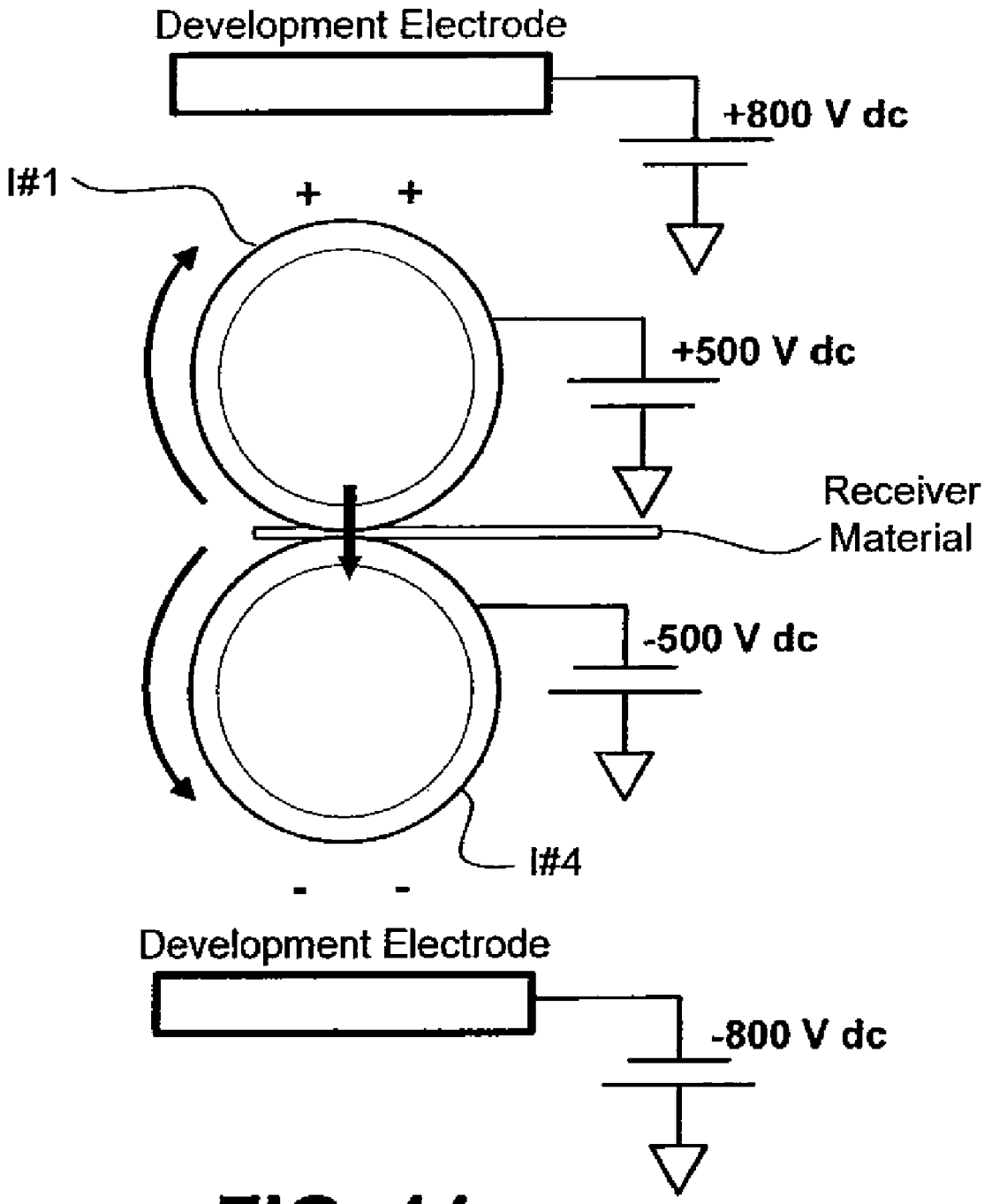
FIG. 11 illustrates an exemplary imaging cycle for a two-roller system for synchronous duplex printing that uses directed aerosol toner development of opposite polarity particles.

FIG. 11 illustrates an exemplary imaging cycle for a two-roller system for synchronous duplex printing that uses directed aerosol toner development of opposite polarity particles. During the imaging cycle, negatively charged particles are placed on the second imaging member I#4 and positively charged particles are placed on the first imaging member I#1 using aerosol toner development. An aperture array print head can be modulated to write directly onto the insulating dielectric surfaces in an image-wise fashion. The electrical substrates are biased to −500 V and +500 V dc respectively to provide an electric field near the surface to attract and hold the negative or positive particle.

In this case, the development electrode is biased at +800 V dc to encourage the positively charged particles to move to the lower potential Imaging Roller #1 surface at +500 V dc. Similarly, a second development electrode is biased at −800 V dc to drive placement of the negatively charged particles on Imaging Roller #4 at −500 V dc.

In this example all voltages are with respect to ground, which is 0Vdc. However, it should be understood that the different rollers in this or other examples might be biased with respect to voltages other than ground. Also, the particular voltage biases described in this and the other examples are merely exemplary in nature, and other voltage biases might also be used.

B. Cycle 2—Transfer of Toner to Receiver

Figure 12:
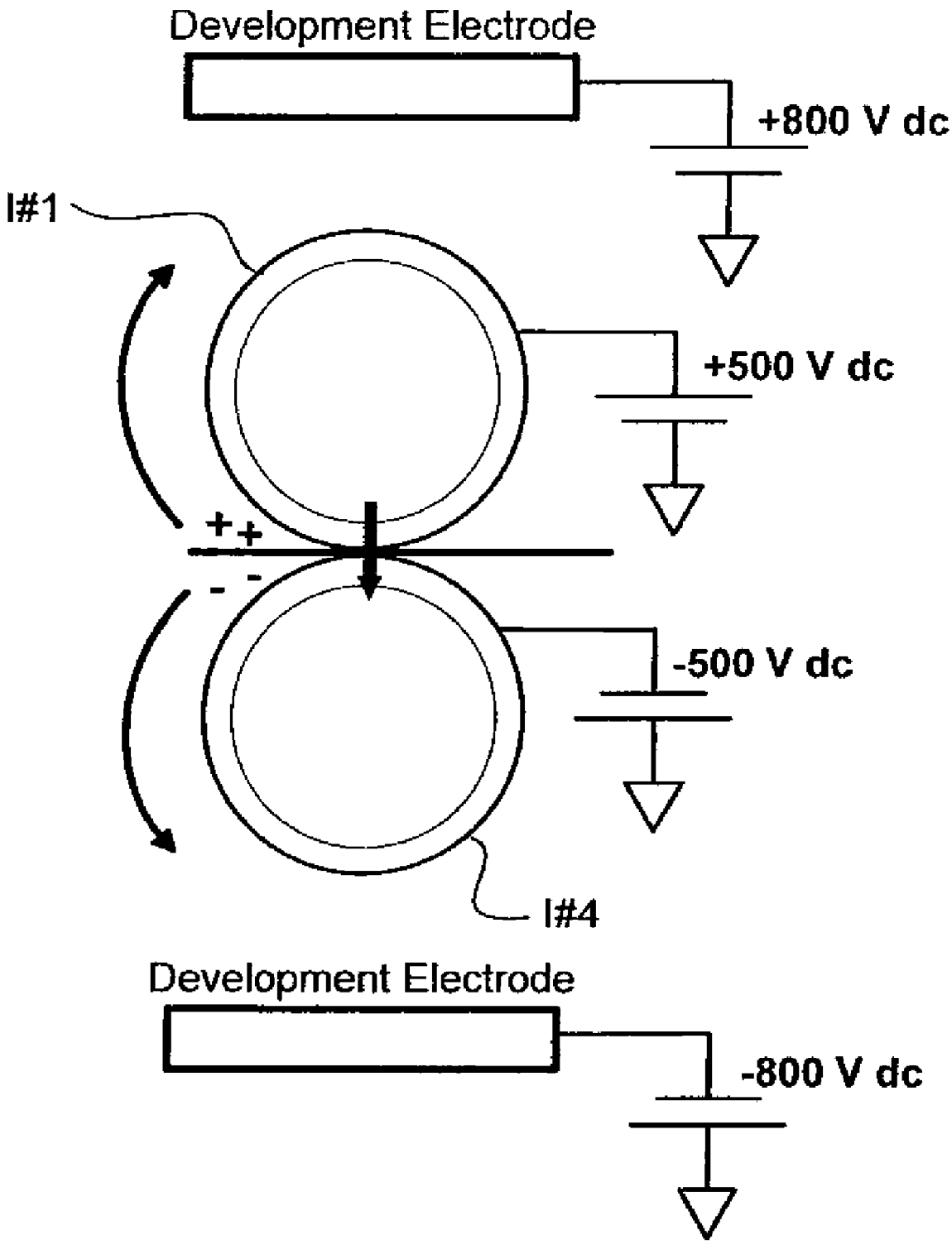
FIG. 12 illustrates an exemplary imaging cycle for a two-roller system for synchronous duplex printing that uses directed aerosol toner development of opposite polarity particles.

FIG. 12 illustrates an exemplary imaging cycle for a two-roller system for synchronous duplex printing that uses directed aerosol toner development of opposite polarity particles. The voltage biases on all rollers remain the same as in the previous cycles.

In this transfer cycle, a positive charged particle is transferred from the first imaging member I#1 to one side of the receiver by the electric field between the first imaging member I#1 and the second imaging member I#4. Synchronously, a negative charged particle is transferred from the second imaging member I#4 to the other side of the receiver by the electric field between the imaging members I#1, I#4. During this transfer cycle an image can continue to be written on the imaging members I#1, I#4 while also transferring to the receiver indefinitely.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more, fewer or other elements may be used in the block diagrams. The claims should not be read as limited to the described order or elements unless stated to that effect.

In addition, use of the term "means" in any claim is intended to invoke 35 U.S.C. §112, paragraph 6, and any claim without the word "means" is not so intended. Therefore, all embodiments that come within the scope and spirit of the following claims and equivalents thereto are claimed as the invention.

The invention claimed is:

1. A duplex imaging system comprising:

a first imaging assembly for imaging on a first side of a receiver material;

a second imaging assembly comprising one or more 2-up split intermediate transfer members for imaging on a second side of the receiver material; and wherein the first and second imaging assemblies use direct electrostatic printing to synchronously image on their respective sides of the receiver material.

2. The imaging system of claim 1, wherein the first imaging assembly includes one or more 2-up split intermediate transfer members.

3. A single pass, direct electrostatic printing system comprising:

a first imaging assembly for printing on a first side of a receiver material;

a second imaging assembly comprising one or more 2-up split intermediate transfer members for printing on a second side of the receiver material;

wherein the first and second imaging assemblies print on their respective sides of the receiver material during a single pass of the receiver material through the printing system.

4. The printing system of claim 3, wherein the first imaging assembly includes a first imaging member and one or more 2-up split intermediate transfer members, and wherein the second imaging assembly includes a second imaging member having one or more 2-up split intermediate transfer members.

5. The printing system of claim 4 wherein the first and second intermediate transfer members rotate with substantially the same angular velocity so as to synchronously transfer images to the receiver material.

6. A duplex printing system comprising:

a first imaging member and a first intermediate transfer member for using direct electrostatic printing to print on a first side of a receiver material;

a second imaging member and a second intermediate transfer for using direct electrostatic printing to print on a second side of the receiver material; and wherein the first and second intermediate transfer members form a single toning nip used to print on the first and second sides of the receiver material during a single pass of the receiver material through the system and wherein the first imaging member comprises a 2-up split roller, and the second imaging member is a 2-up split roller.

7. The printing system of claim 6 wherein the first and second intermediate transfer members rotate with substantially the same angular velocity so as to synchronously transfer images to the receiver material.

* * * * *